US006334309B1

(12) United States Patent
Dean et al.

(10) Patent No.: US 6,334,309 B1
(45) Date of Patent: Jan. 1, 2002

(54) LIQUID FUEL INJECTOR FOR BURNERS IN GAS TURBINES

(75) Inventors: Anthony Dean, Scotia, NY (US); Luciano Mei; Alessio Miliani, both of Florence (IT)

(73) Assignee: Nuovo Pignone Holding S.p.A, Florence (IT)

( * ) Notice: Subject to any disclaimer, the term of this patent is extended or adjusted under 35 U.S.C. 154(b) by 0 days.

(21) Appl. No.: 09/579,510

(22) Filed: May 26, 2000

(30) Foreign Application Priority Data

May 31, 1999 (IT) ..... MI99A1204

(51) Int. Cl.[7] ..... F23R 3/32
(52) U.S. Cl. ..... 60/737
(58) Field of Search ..... 60/737; 239/403, 239/470

(56) References Cited

U.S. PATENT DOCUMENTS 4,198,815 A 4/1980 Bobo et al.
5,461,865 A 10/1995 Snyder et al.
5,778,676 A 7/1998 Joshi et al.
6,068,470 A * 5/2000 Zarzalis ..... 431/187

FOREIGN PATENT DOCUMENTS

EP 0 769 657 A2 4/1997

* cited by examiner

*Primary Examiner*—Charles G. Freay
*Assistant Examiner*—Ehud Gartenberg
(74) *Attorney, Agent, or Firm*—Nixon & Vanderhye

(57) ABSTRACT

The present invention relates to a liquid fuel injector (10) for burners in gas turbines, of the type used inside burners which are provided with a pre-mixing chamber (62) and an element (13) to create turbulence in the flow of compressed air obtained from the compressor of the gas turbine. The injector (10) comprises a body (11) which ends in a tip (12) and is provided with at least one duct (25) for passage of the fuel, and ducts (48, 58) for the inflow of compressed air from the compressor of the turbine, wherein the duct (25) for the fuel and the ducts (48, 58) for the compressed air end in respective outlet holes. The tip (12) of the injector (10) ends at the median part of the converging portion (61) of the pre-mixing chamber (62).

15 Claims, 3 Drawing Sheets

LIQUID FUEL INJECTOR FOR BURNERS IN GAS TURBINES

The present invention relates to a liquid fuel injector for burners in gas turbines.

As is known, gas turbines are machines which consist of a compressor and of a turbine with one or more stages, wherein these components are connected to one another by a rotary shaft, and wherein a combustion chamber is provided between the compressor and the turbine.

In order to pressurise the compressor, it is supplied with air obtained from the external environment.

The compressed air passes through a series of premixing chambers, which end in a nozzle or a converging portion, into each of which an injector supplies fuel which is mixed with the air, in order to form an air-fuel mixture to be burnt.

There is admitted into the combustion chamber the fuel which is necessary in order to produce the combustion, which is designed to give rise to an increase in the temperature and enthalpy of the gas.

Subsequently, via corresponding ducts, the high-temperature, high-pressure gas reaches the turbine, which transforms the enthalpy of the gas into mechanical energy which is available to a user.

Between the compressor and the combustion chamber there is provided a series of burner units, the functions of which include supplying the liquid fuel, obtained from a remote tank, to the combustion chamber.

Known burner units have a complex structure, inside which there is present an injector, contained in a converging body, which in the technical language is generally known as the shroud.

In turn the injector, which, it will be appreciated, is connected to a supply duct for the liquid fuel, generally has a body which is provided with a cylindrical portion and a pointed end portion.

The liquid fuel injectors for burners in known gas turbines have a duct which is used in order to permit passage of the fuel, and are provided with ducts for the inflow of compressed air from the compressor of the turbine.

Both the duct for the fuel and the ducts for the compressed air end in corresponding outlet holes, wherein the air output from the injector is used to vaporise the fuel in order to improve the characteristics of the combustion.

In addition, there is associated with the converging body an element which is generally known according to the art as the swirler, which is used to intercept the flow of air obtained from the compressor, and has a complex shape, consisting of two series of blades, oriented in opposite directions, which are designed to produce a turbulent flow of the compressed air obtained from the compressor, thus permitting corresponding mixing of the air itself with the liquid fuel injected by the injector into the pre-mixing chamber.

Problems which occur particularly in the technical field of burners concern the need to obtain optimum atomisation of the liquid fuel, as well as mixing which is suitable for the different characteristics of the fuels used.

In addition, it is desirable to avoid unwanted return of the flame towards the burner, which leads to the machine being switched off.

Finally, it is desirable to obtain optimum conditions of turbulence of the fluids present in the pre-mixing area, and to reduce the emission of by-products of the combustion, and in particular pollutants such as nitric oxides.

The object of the present invention is thus to provide a liquid fuel injector for burners in gas turbines, which has an extremely simple and compact structure, whilst maintaining optimum fluid-dynamic characteristics, as previously described.

Another object of the invention is to provide a liquid fuel injector for burners in gas turbines, which permits optimum reliability of use of the machine.

Another object of the invention is to provide a liquid fuel injector for burners in gas turbines, which can be produced at a low cost, and consists of a reduced number of component parts.

These and other objects are achieved by a liquid fuel injector for burners in gas turbines, of the type used inside burners which are provided with a pre-mixing chamber and an element to create turbulence in the flow of compressed air obtained from the compressor of the said gas turbine, the said injector comprising a body which ends in a tip and is provided with at least one duct for passage of the fuel, and ducts for the inflow of compressed air from the compressor of the said turbine, wherein the said duct for the fuel and the said ducts for the compressed air end in respective outlet holes, characterised in that the tip of the said injector ends at the median part of the converging portion of the said pre-mixing chamber.

According to a preferred embodiment of the present invention, the holes for lateral discharge of the compressed air are located downstream from the holes from which the liquid fuel is discharged.

In addition, the centre of each of the holes for lateral discharge of the compressed air is located on a line parallel to the axis of the injector, relative to the corresponding hole for discharge of the liquid fuel.

According to a preferred embodiment of the present invention, the holes for lateral discharge of the compressed air, and the holes for discharge of the liquid fuel, are located downstream from the element for the turbulence, and in a position which is clearly separated from the latter.

According to another preferred embodiment of the present invention, the body of the injector has a plurality of intake ducts, in order to permit intake of the compressed air from the said compressor.

According to a further preferred embodiment of the present invention, inside its own tip the injector has a duct which is in communication with the ducts for passage of the compressed air, and ends in a hole, from the front of which the compressed air is discharged.

In addition, the injector according to the present invention is provided with a tube, which is outside the one for supply of the liquid fuel, and acts as a thermal insulator. The two tubes are kept equally spaced from one another by means of a corresponding spring.

Further characteristics of the invention are defined in the claims attached to the present patent application.

Further objects and advantages of the present invention will become apparent from examination of the following description and the attached drawings, which are provided purely by way of non-limiting example, and in which.

With particular reference to the figures in question, the liquid fuel injector for burners in gas turbines, according to the present invention, is indicated as a whole by the reference number 10.

Figure 1:
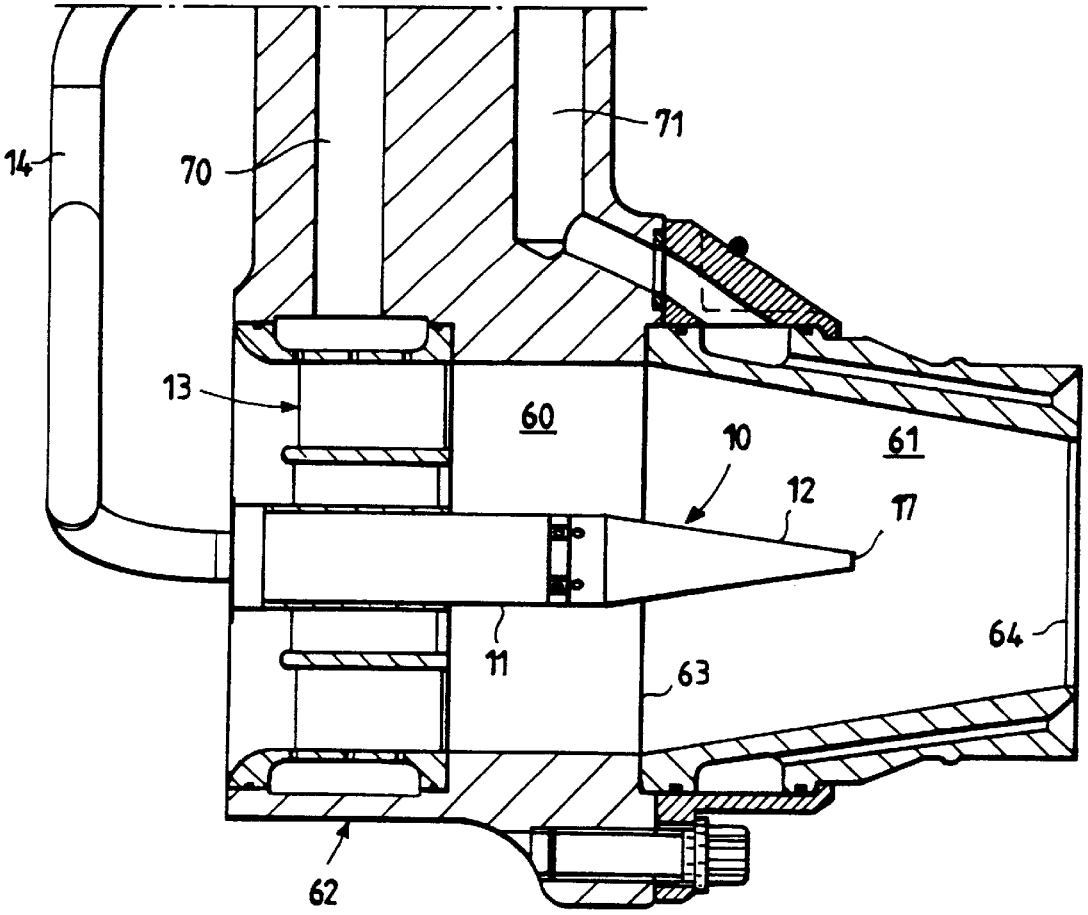
FIG. 1 shows a view, partially in cross-section, of a burner for gas turbines, provided with an injector according to the present invention.

More particularly, as can be seen in FIG. 1, the liquid fuel injector 10 for burners in gas turbines, according to the present invention, is of the type used inside burners which are provided with a pre-mixing chamber 62 and an element 13, generally known as a swirler, which is used in order to create appropriate turbulence in the flow of compressed air obtained from the compressor of the gas turbine.

The pre-mixing chamber 62 has a first section 60, which is substantially cylindrical, and a final converging portion 61, which according to the art is known as the shroud.

FIG. 1 also shows the line 63 of separation between the cylindrical section 60 and the final converging portion 61.

The injector 10 is connected to a tube 14, through which the liquid fuel is supplied, whereas there are also associated with the pre-mixing chamber 62 a primary gas duct 70 and a duct 71, which belong to the pilot circuit of the flame.

The injector 10 comprises a body 11, which ends in a tip 12, and is provided with a duct 25 for passage of the fuel obtained from the tube 21.

The duct 25 for the liquid fuel is extended inside a structure 26, which is described in greater detail hereinafter, and communicates with outlet holes 22 and 23 for the fuel.

As can be seen in FIG. 1, the injector 10 is inserted centrally relative to the swirler 13, for a section which corresponds to part of the length of the body 11.

In addition, the tip 12 of the injector 10 ends at the median part of the converging portion 61 of the pre-mixing chamber 62, leaving a substantial space free before the outlet 64 of the converging portion 61.

Figure 2:
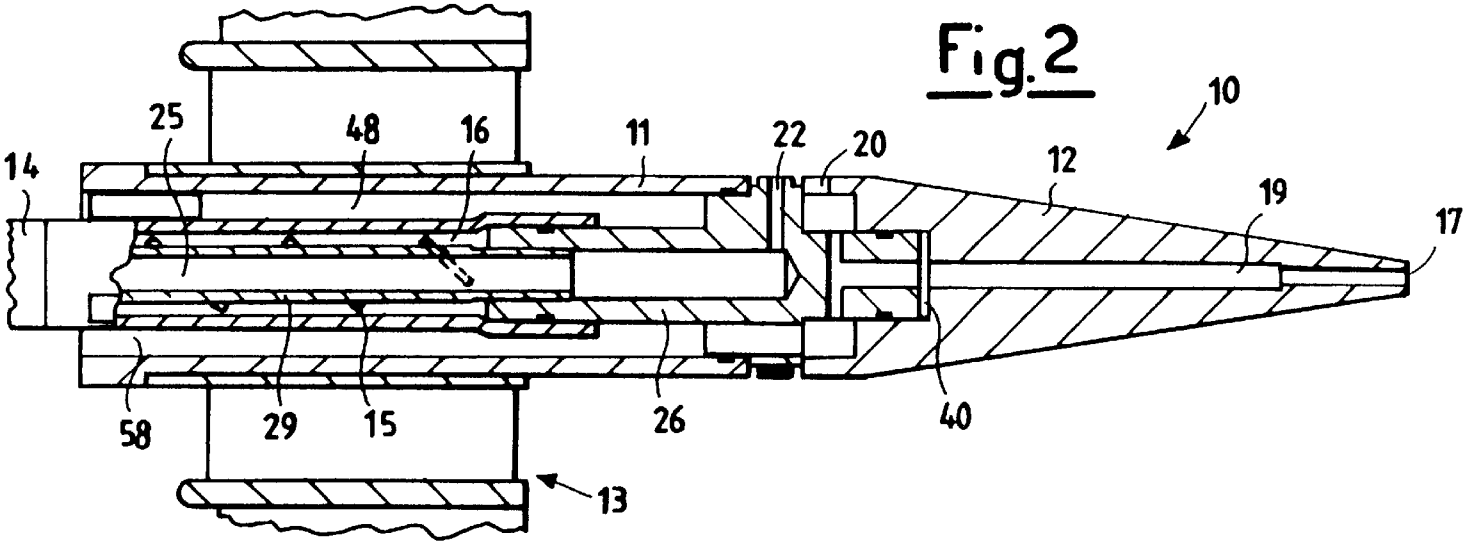
FIG. 2 shows a view, partially in cross-section, of an injector for gas turbines, according to the present invention.

If the inner structure of the injector 10, which can be seen in cross-section in FIG. 2, is now examined, it can be seen that the injector is also provided with ducts indicated by the reference numbers 48 and 58, which permit inflow of compressed air obtained from the compressor (not shown) of the gas turbine.

The ducts 48 and 58 communicate with outlet holes 20 and 21 for the compressed air.

If the arrangement of the holes 20, 21, 22 and 23 is examined, it can be seen that the holes 20 and 21 for lateral discharge of the compressed air are located downstream from the holes 22 and 23, from which the liquid fuel is discharged.

Preferably, the centre of each of these holes 20 and 21 for lateral discharge of the compressed air is located on a line which is parallel to the axis of the said injector 10, relative to the corresponding holes 22 and 23 for discharge of the liquid fuel.

An important characteristic of the injector according to the invention consists in the fact that the holes 20 and 21 for lateral discharge of the compressed air, and the holes 22 and 23 for discharge of the liquid fuel, are located downstream from the swirler 13, and in a position which is clearly separated from the latter.

Figure 4:
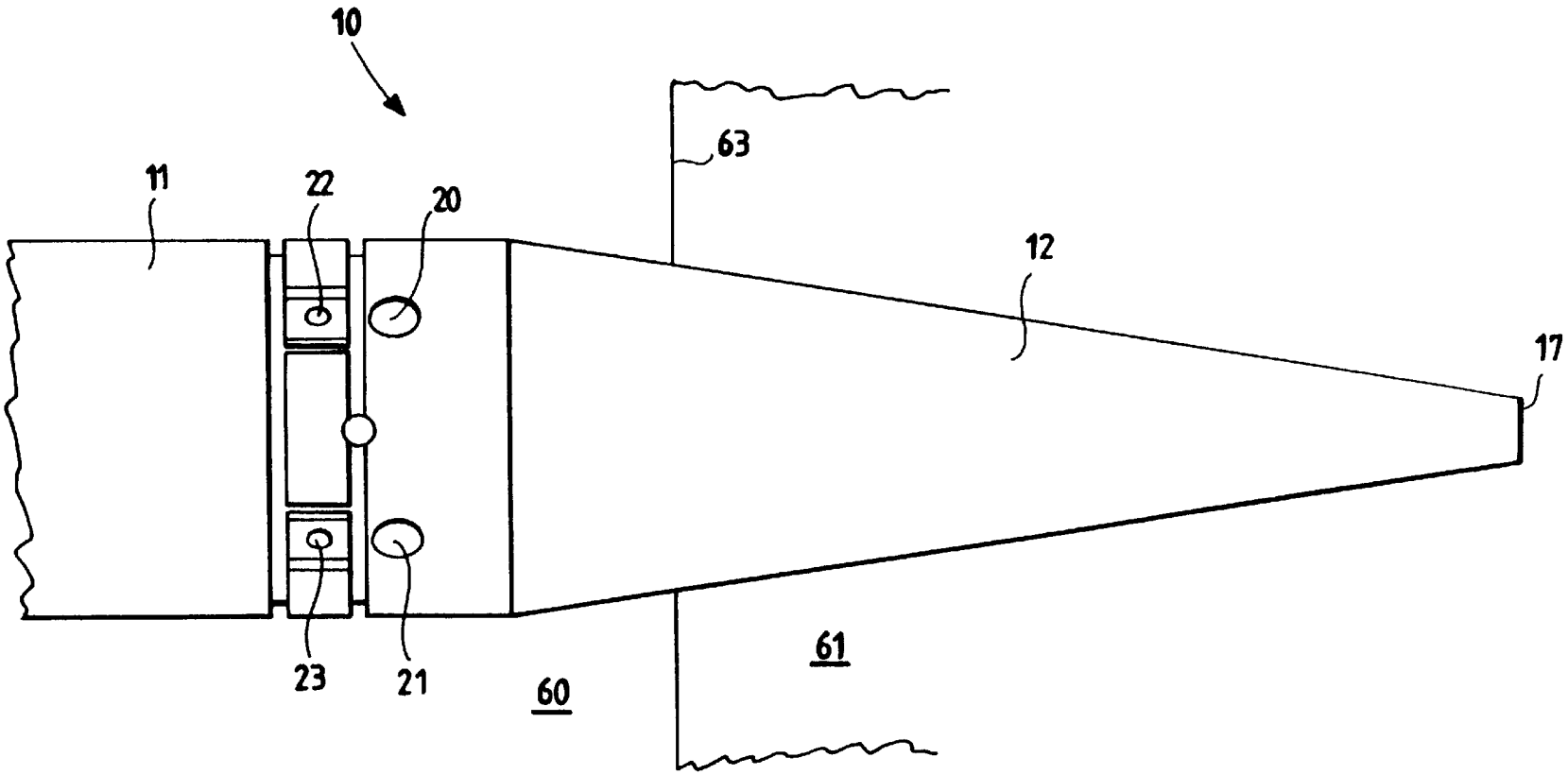
FIG. 4 shows a lateral view of a detail of the injector for gas turbines, according to the present invention.

FIG. 4 also shows in detail the fact that the holes 20, 21 for lateral discharge of the compressed air, and the holes 22 and 23 for discharge of the liquid fuel, are located inside the cylindrical section 60 of the pre-mixing chamber 62 of the burner.

In particular, both the holes 20 and 21 for lateral discharge of the compressed air, and the holes 22 and 23 for discharge of the liquid fuel, have their own axis oriented radially relative to the body 11 of the injector 10.

More particularly, both the holes 20 and 21 for lateral discharge of the compressed air, and the holes 22 and 23 for discharge of the liquid fuel, have an oval cross-section.

In addition, the holes 22 and 23 are preferably smaller than the holes 20 and 21.

As previously stated, the body 11 of the injector 10 has a central hole, inside which the tube 14 for supply of the liquid fuel is inserted.

Figure 3:
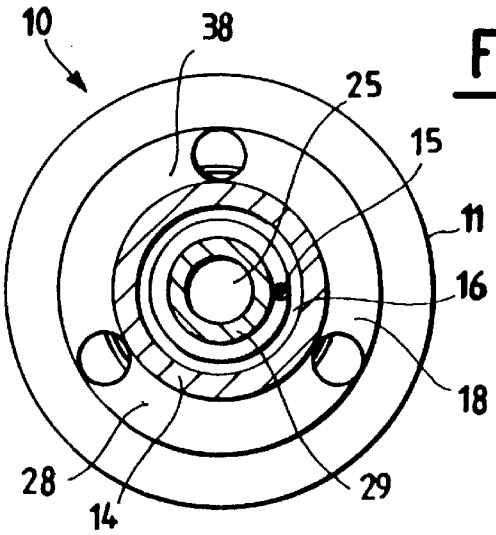
FIG. 3 shows a view of the injector in FIGS. 1 and 2, in cross-section along a plane which is perpendicular to the axis of the injector.

As can be seen in FIG. 3, the body 11 of the injector 10 also has a plurality of intake ducts 18, 28, 38 in order to permit intake of the compressed air from the compressor.

Incidentally, it will be noted that there are three ducts 18, 28 and 38 for intake of compressed air, in the embodiment of the present invention which is illustrated by way of non-limiting example.

Inside the tip 12, the injector 10 also has a channel 19, which communicates with the channels 48 and 58, and ends in a hole 17, from the front of which the compressed air is discharged.

Inside the tip 12, and in communication with the duct 19, an air gap 40 is also present.

The tube 14 for supply of the liquid fuel has an isolation gap 16, which is provided such as to surround, together with a spring 15, an inner pipe 20 which defines the duct 25 for the liquid fuel.

Inside the injector 10, there is provided the aforementioned drilled structure 26, the function of which is to connect the end portion of the tube 14 for supply of the liquid fuel, such as to create a single channel 25 for passage of the liquid fuel.

In addition the drilled structure 26 communicates with the holes 22 and 23, from which the liquid fuel is discharged.

The functioning of the liquid fuel injector 10 for burners in gas turbines, according to the present invention, is described briefly hereinafter.

The liquid fuel is supplied from a remote tank, by means of the tube 14, to the injector 10, such as to supply to the main flame of the burner.

Simultaneously, the compressed air obtained from the burner is admitted upstream from the injector 10, and comes into contact with the swirler 13, such that turbulence is created in the flow of compressed air, and this makes it possible to stabilise the flame downstream from the injector 10.

The liquid fuel travels along the duct 25, and is discharged from the holes 22 and 23, which are disposed radially along the body 11 of the injector 10.

Simultaneously, the air obtained from the compressor travels along the ducts 48 and 58, and is discharged from the outlet holes 20 and 21.

Owing to the fact that the holes 20 and 21 for lateral discharge of the compressed air are located downstream from the holes 22 and 23, from which the liquid fuel is discharged, a film of air is created on the tip 12 of the injector 10, thus preventing the liquid fuel from being deposited on the injector itself.

This effect is increased by the fact that the centre of the holes 20 and 21 for the compressed air are located on lines which are parallel to the axis of the injector 10, relative to the corresponding holes 22 and 23 for discharge of the liquid fuel.

In addition, along its own path inside the injector 10, the compressed air also follows the duct 19, which in turn communicates with the ducts 48 and 58, such as to be discharged at the front from the hole 17.

This effect makes it possible to control satisfactorily the temperature of the tip of the injector 10.

It should also be noted that the tip 12 of the injector 10 ends at the median part of the converging portion 61 of the pre-mixing chamber 62.

This characteristic, in association with the converging shape of the portion 61, permits optimum properties of the flame.

In addition, the fact that the holes 20 and 21 for lateral discharge of the compressed air, and the holes 22 and 23 for discharge of the liquid fuel, are located in a position which is clearly separated from the swirler 13, makes it possible to obtain ideal mixing of the fuel.

The description provided makes apparent the characteristics and advantages of the liquid fuel injector for burners in gas turbines which is the subject of the present invention.

Finally, it is apparent that many variants can be made to the liquid fuel injector for burners in gas turbines which is the subject of the present invention, without departing from the principles of novelty which are inherent in the inventive concept, and it is also apparent that any materials, shapes and dimensions can be used, as required, in the practical embodiment of the invention, and can be replaced by others which are technically equivalent.

What is claimed is:

1. Liquid fuel injector for burners in gas turbines, of the type used inside burners which are provided with a pre-mixing chamber (62) and an element (13) to create turbulence in the flow of compressed air obtained from the compressor of the said gas turbine, the said injector (10) comprising a body (11) which ends in a tip (12) and is provided with at least one duct (25) for passage of the fuel, and ducts (48, 58) for the inflow of compressed air from the said turbine, wherein the said duct (25) for the fuel and the said ducts (48, 58) for the compressed air end in respective outlet holes (20, 21, 22, 23), characterised in that the tip (12) of the said injector (10) ends at the median part of the converging portion (61) of the said pre-mixing chamber (62).

2. Fuel injector according to claim 1, characterised in that the said holes (20, 21) for lateral discharge of the compressed air are located downstream from the holes (22, 23) from which the liquid fuel is discharged.

3. Fuel injector according to claim 2, characterised in that each of the holes (20, 21) for lateral discharge of the compressed air is aligned with the corresponding hole (22, 23) for discharge of the liquid fuel.

4. Fuel injector according to claim 3, characterised in that the said holes (20, 21) for lateral discharge of the compressed air, and the said holes (22, 23) for discharge of the liquid fuel, are located downstream from the said element (13) for turbulence, and in a position which is clearly separated from the latter.

5. Fuel injector according to claim 4, characterised in that the said holes (20, 21) for lateral discharge of the compressed air, and the said holes (22, 23) for discharge of the liquid fuel, are located inside the cylindrical section (60) of the said pre-mixing chamber (62).

6. Fuel injector according to claim 4, characterised in that both the said holes (20, 21) for lateral discharge of the compressed air, and the said holes (22, 23) for discharge of the liquid fuel, have their own axis oriented radially relative to the body (11) of the said injector (10).

7. Fuel injector according to claim 6, characterised in that both the said holes (20, 21) for lateral discharge of the compressed air are significantly larger than the corresponding holes (22, 23) for discharge of the liquid fuel.

8. Fuel injector according to claim 6, characterised in that both the said holes (20, 21) for lateral discharge of the compressed air, and the said holes (22, 23) for discharge of the liquid fuel, have an oval cross-section.

9. Fuel injector according to claim 1, characterised in that the body (11) of the injector (10) has a central hole, inside which a tube (14) for supply of the liquid fuel is inserted.

10. Fuel injector according to claim 9, characterised in that the body (11) of the injector (10) has a plurality of intake ducts (18, 28, 38), in order to permit intake of the compressed air from the said compressor.

11. Fuel injector according to claim 10, characterised in that inside the tip (12) it has a duct (19), wherein the said duct (19) communicates with the ducts (48, 58), and ends in a hole (17), from the front of which the compressed air is discharged.

12. Fuel injector according to claim 11, characterised in that it has an air gap (40), inside the tip (12), and in communication with the said duct (19).

13. Fuel injector according to claim 12, characterised in that it has a pipe (20), which defines the said duct (25) for the liquid fuel, inside the said supply tube (14), wherein the said pipe (20) is surrounded by a spring (15), in order to define an isolation gap (16).

14. Fuel injector according to claim 13, characterised in that inside the injector (10), there is present a drilled structure (26), to connect the end portion of the said tube (14) to the liquid fuel supply, such as to create a single duct (25) for passage of the liquid fuel.

15. Fuel injector according to claim 14, characterised in that the said drilled structure (25) communicates with the said holes (22, 23) from which the liquid fuel is discharged.

* * * * *